US009922592B2

(12) United States Patent
Parikh et al.

(10) Patent No.: US 9,922,592 B2
(45) Date of Patent: Mar. 20, 2018

(54) DISPLAY CONTROL BASED ON A DIGITAL SIGNAL

(71) Applicant: Intel Corporation, Santa Clara, CA (US)

(72) Inventors: Kunjal Parikh, San Jose, CA (US); Khaled Ahmed, Anaheim, CA (US); Prakash K. Radhakrishnan, Portland, OR (US); Peter L. Chang, Portland, OR (US); Ravi Ranganathan, Sunnyvale, CA (US)

(73) Assignee: INTEL CORPORATION, Santa Clara, CA (US)

( * ) Notice: Subject to any disclaimer, the term of this patent is extended or adjusted under 35 U.S.C. 154(b) by 117 days.

(21) Appl. No.: 14/757,637

(22) Filed: Dec. 23, 2015

(65) Prior Publication Data

US 2017/0186366 A1 Jun. 29, 2017

(51) Int. Cl.
*G09G 3/32* (2016.01)
*G09G 3/20* (2006.01)

(52) U.S. Cl.
CPC ..... *G09G 3/32* (2013.01); *G09G 3/2003* (2013.01); *G09G 2300/0404* (2013.01); *G09G 2310/08* (2013.01); *G09G 2320/0242* (2013.01)

(58) Field of Classification Search
None
See application file for complete search history.

(56) References Cited

U.S. PATENT DOCUMENTS

2006/0279519 A1 12/2006 Wang
2010/0259510 A1 10/2010 Lee
2011/0080440 A1* 4/2011 Cheon ..... G09G 3/3648 345/691
2011/0096067 A1 4/2011 Guo et al.
2015/0042551 A1 2/2015 Hsu et al.

OTHER PUBLICATIONS

PCT International Search Report, PCT Application No. PCT/US2016/058737, dated Feb. 1, 2017, 3 pages.

* cited by examiner

*Primary Examiner* — Kenneth B Lee, Jr.
(74) *Attorney, Agent, or Firm* — Grossman Tucker Perreault & Pfleger, PLLC

(57) ABSTRACT

In one example, a method for controlling a display with a digital signal includes detecting a binary value from a timing controller, the binary value corresponding to a portion of an image to be displayed. The method can also include determining a previous binary value from the timing controller and calculating a difference between the binary value from the timing controller and the previous binary value from the timing controller. Furthermore, the method can include generating an encoded signal based on the difference and transmitting the encoded signal to a display panel.

20 Claims, 3 Drawing Sheets

200

DISPLAY CONTROL BASED ON A DIGITAL SIGNAL

TECHNICAL FIELD

This disclosure relates generally to controlling a display and specifically, but not exclusively, to controlling a display based on a digital signal.

BACKGROUND

Display devices commonly include light-emitted diodes (LEDs), which provide a two-lead semiconductor light source. When a suitable voltage is applied to the light-emitted diodes, light is emitted. In some examples, display devices can include micro-LEDs that include arrays of microscopic LEDs that form individual pixel elements. The micro-LEDs can receive an analog signal to display images.

BRIEF DESCRIPTION OF THE DRAWINGS

The following detailed description may be better understood by referencing the accompanying drawings, which contain specific examples of numerous features of the disclosed subject matter.

In some cases, the same numbers are used throughout the disclosure and the figures to reference like components and features. Numbers in the 100 series refer to features originally found in FIG. 1; numbers in the 200 series refer to features originally found in FIG. 2; and so on.

DESCRIPTION OF THE EMBODIMENTS

A growing number of flat panel display technologies are incorporating micro-LEDs, which use arrays of microscopic LEDs to form individual pixel elements. The micro-LED technology uses less energy than other comparable display devices that rely on organic LEDs, and the like. Furthermore, micro-LED display devices can be easily read in direct sunlight. However, some embodiments display images with micro-LEDs by providing currents to the micro-LEDs. The current values must be precise or there can be an exponential decrease in quantum efficiency of the micro-LEDs.

The techniques described herein include displaying images with micro-LEDs by providing digital signals to the micro-LEDs. In some embodiments, the digital signals transmitted to micro-LEDs in a display device can be based on a maximum voltage for the display device. The techniques described herein can include detecting a binary value from a timing controller, wherein the binary value corresponds to a portion of an image to be displayed. The techniques can also include calculating a difference between the binary value from the timing controller and a previous binary value from the timing controller. The techniques can then include generating an encoded signal based on the difference and transmitting the encoded signal to the display panel. Accordingly, the encoded signal, which is a digital signal based on a binary value, can be transmitted directly to a display panel in order to display an image. Therefore, the techniques enable a display device to display an image without a digital to analog converter or a driver amplifier.

Reference in the specification to "one embodiment" or "an embodiment" of the disclosed subject matter means that a particular feature, structure, or characteristic described in connection with the embodiment is included in at least one embodiment of the disclosed subject matter. Thus, the phrase "in one embodiment" may appear in various places throughout the specification, but the phrase may not necessarily refer to the same embodiment.

Figure 1:
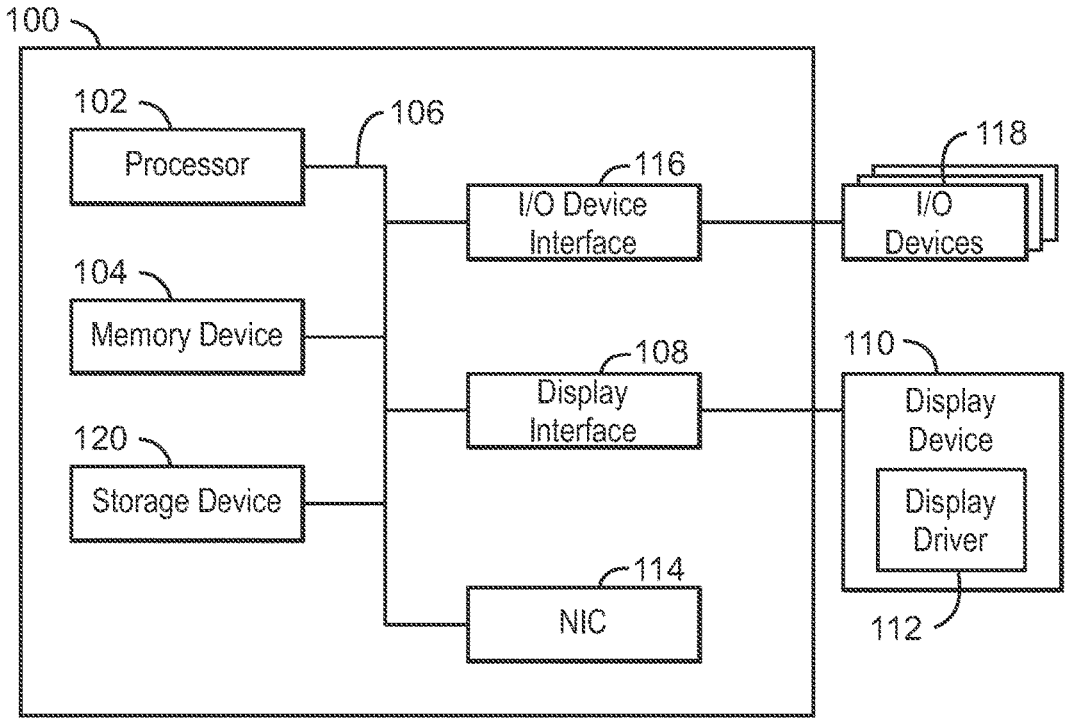
FIG. 1 illustrates a block diagram of a computing device that can transmit a generated encoded sequence to a display device.

FIG. 1 is a block diagram of an example of a host computing device that can transmit a generated encoded sequence to a display device. The host computing device 100 may be, for example, a mobile phone, laptop computer, desktop computer, or tablet computer, among others. The host computing device 100 may include a processor 102 that is adapted to execute stored instructions, as well as a memory device 104 that stores instructions that are executable by the processor 102. The processor 102 can be a single core processor, a multi-core processor, a computing cluster, or any number of other configurations. The memory device 104 can include random access memory, read only memory, flash memory, or any other suitable memory systems. The instructions that are executed by the processor 102 may be used to implement a method that can transmit a generated encoded sequence to a display device.

The processor 102 may also be linked through the system interconnect 106 (e.g., PCI®, PCI-Express®, NuBus, etc.) to a display interface 108 adapted to connect the host computing device 100 to a display device 110. The display device 110 may include a display screen that is a built-in component of the host computing device 100. The display device 110 may also include a computer monitor, television, or projector, among others, that is externally connected to the host computing device 100. The display device 110 can include light emitting diodes (LEDs), and micro-LEDs, among others. In some embodiments, the display interface 108 can include a display driver 112 that can generate an encoded signal and transmit the encoded signal to the display device 110. For example, the display driver 112 can detect a binary value from a timing controller and determine a previous binary value from the timing controller. The display driver 112 can also calculate a difference between the binary value from the timing controller and the previous binary value from the timing controller and generate an encoded signal based on the difference. Furthermore, the display driver 112 can transmit the encoded signal to the display panel.

In addition, a network interface controller (also referred to herein as a NIC) 114 may be adapted to connect the host computing device 100 through the system interconnect 106 to a network (not depicted). The network (not depicted) may be a cellular network, a radio network, a wide area network (WAN), a local area network (LAN), or the Internet, among others.

The processor 102 may be connected through a system interconnect 106 to an input/output (I/O) device interface 116 adapted to connect the computing host device 100 to one or more I/O devices 118. The I/O devices 118 may include, for example, a keyboard and a pointing device, wherein the pointing device may include a touchpad or a touchscreen, among others. The I/O devices 118 may be built-in components of the host computing device 100, or may be devices that are externally connected to the host computing device 100.

In some embodiments, the processor 102 may also be linked through the system interconnect 106 to a storage device 120 that can include a hard drive, an optical drive, a USB flash drive, an array of drives, or any combinations thereof. In some embodiments, the storage device 120 can include any suitable applications.

It is to be understood that the block diagram of FIG. 1 is not intended to indicate that the host computing device 100 is to include all of the components shown in FIG. 1. Rather, the host computing device 100 can include fewer or additional components not illustrated in FIG. 1 (e.g., additional memory components, embedded controllers, additional modules, additional network interfaces, etc.). Furthermore, any of the functionalities of the display driver 112 may be partially, or entirely, implemented in hardware and/or in the processor 102. For example, the functionality may be implemented with an application specific integrated circuit, logic implemented in an embedded controller, or in logic implemented in the processor 102, among others. In some embodiments, the functionalities of the display driver 112 can be implemented with logic, wherein the logic, as referred to herein, can include any suitable hardware (e.g., a processor, among others), software (e.g., an application, among others), firmware, or any suitable combination of hardware, software, and firmware.

Figure 2:
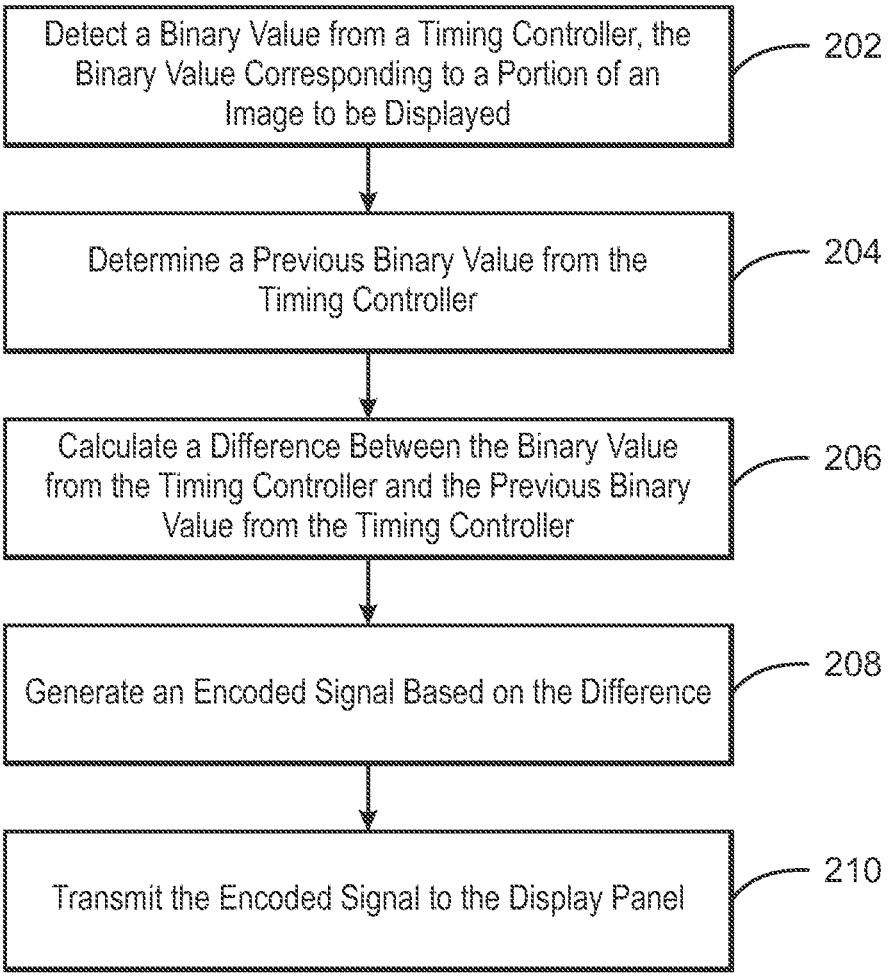
FIG. 2 illustrates a process flow diagram for generating an encoded sequence.

FIG. 2 illustrates a process flow diagram for generating an encoded sequence. The method 200 illustrated in FIG. 2 can be implemented with any suitable computing component or device, such as display device 110 of FIG. 1.

At block 202, the display driver 112 can detect a binary value from a timing controller. The binary value can include any suitable data received by the display device that is to be displayed. For example, the binary value can correspond to a portion of an image transmitted from a computing device to a display device. In some embodiments, the timing controller can receive the binary value from a memory device in the display device. The timing controller s explained in greater detail below in relation to FIG. 3.

At block 204, the display driver 112 can determine a previous binary value from the timing controller. For example, the display driver 112 can store any suitable number of binary values retrieved from the timing controller. In some embodiments, the display driver 112 may store the current or most recent binary value retrieved from the timing controller and the binary value retrieved from the timing controller preceding the current binary value.

At block 206, the display driver 112 can calculate a difference between the binary value from the timing controller and the previous binary value from the timing controller. For example, the display driver 112 can use any suitable shifting operation, mathematical operation, or any other techniques for calculating the difference between two subsequent binary values retrieved from the timing controller.

At block 208, the display driver 112 can generate an encoded signal based on the difference. For example, the display driver 112 can generate an encoded signal corresponding to a gray value that is to be displayed. In some embodiments, the display driver 112 can generate a set of encoded signals, wherein each of the encoded signals corresponds to a separate gray value based on a separate difference value between current binary values and previous binary values received from the timing controller. In some examples, each of the encoded signals comprises at least one period of time for providing a maximum voltage. For example, each encoded signal can include any suitable period of times during which a maximum voltage is applied to a display panel and any suitable period of times during which power is not applied to a display panel. Accordingly, a color value can be displayed at a display panel by applying a maximum voltage in a particular sequence based on the encoded signal. For example, each of the encoded signals can include a different density of encoded pulses based on each different gray value. In some embodiments, each gray value represents a number of pulses to be included in each encoded signal.

At block 210, the display driver 112 can transmit the encoded signal to the display panel. In some embodiments, the display driver 112 can transmit the encoded signal directly to the display panel without amplification. Thus, a driver amplifier circuit may not be included in the display device. Similarly, a digital to analog converter may not be included in the display device since the encoded signal transmitted to the display panel is a digital signal. In some examples, the display driver 112 can repeatedly send the encoded signal to the display at a predetermined frame rate. In some embodiments, the display panel can be a micro-LED display panel, LED display panel, or any other suitable display panel. A micro-LED display panel, as referred to herein, can include any suitable number of microscopic LEDs forming individual pixel elements in a display panel.

The process flow diagram of FIG. 2 is not intended to indicate that the operations of the method 200 are to be executed in any particular order, or that all of the operations of the method 200 are to be included in every case. Additionally, the method 200 can include any suitable number of additional operations.

Figure 3:
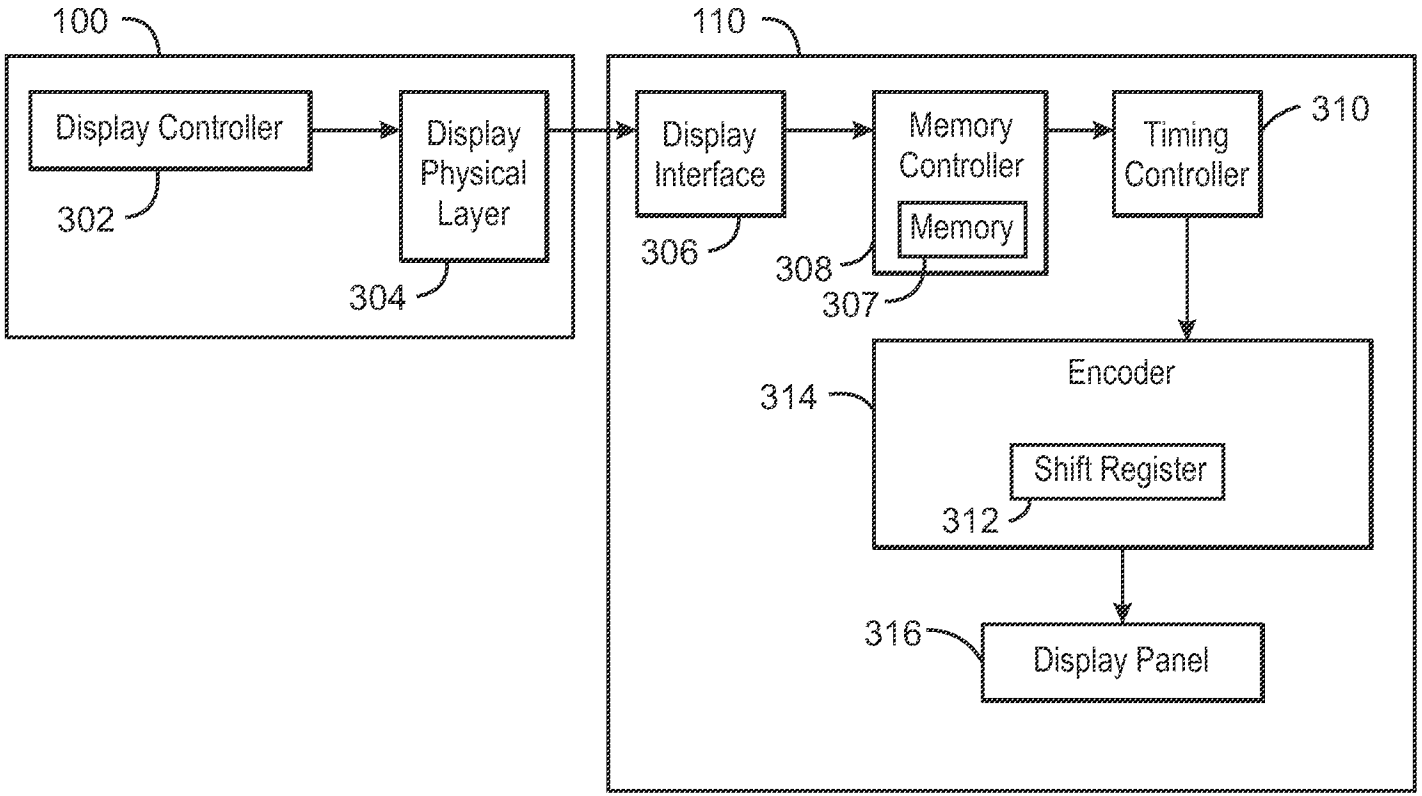
FIG. 3 illustrates a block diagram of an example driver that can generate an encoded sequence.

FIG. 3 illustrates a block diagram of an example driver that can generate an encoded sequence. In some embodiments, the driver illustrated in FIG. 3 can correspond to functionalities implemented by the display driver 112 of FIG. 1.

In some embodiments, a display controller 302 can display data by sending the data through a display physical layer 304 of a computing device 100 to a display interface 306 in a display device 110. The display interface 306 can send the data to memory registers 307 via a memory controller 308. A timing controller (TCON) 310, can transmit the data to a shift register 312 included in an encoder 314. In some embodiments, the timing controller 310 transmits the data from the memory 307 to the encoder 314 based on a predetermined timing sequence.

In some examples, the encoder 312 can store any suitable number of binary values retrieved from the timing controller 310. For example, the encoder 312 may store a current binary value from the timing controller and a previous binary value from the timing controller. The encoder 312 can calculate the difference between the current binary value from the timing controller 310 and the preceding binary value retrieved from the timing controller 310. The encoder 312 can also generate an encoded signal corresponding to the difference, wherein the encoded signal indicates a gray value to be displayed by a display panel 316. The encoder 312 can send the encoded signal to the display panel 316, which can include micro-LEDs, LEDs, and the like. Thus, in some embodiments, the encoder 314 can perform the functions of the shift register 312, a digital to analog converter, and a driver amplifier, among others. Accordingly, the encoder 312 can enable a display device to display an image without a digital to analog circuit or a signal amplifier.

EXAMPLE 1

In some examples, a system for controlling a display panel with a digital signal can include logic to detect a binary value from a timing controller, the binary value corresponding to a portion of an image to be displayed. The logic can also determine a previous binary value from the timing controller and calculate a difference between the binary value from the timing controller and the previous binary value from the timing controller. Furthermore, the logic can generate an encoded signal based on the difference and transmit the encoded signal to the display panel.

Alternatively, or in addition, the logic can generate a set of encoded signals, wherein each of the encoded signals corresponds to a separate gray value based on a separate difference value between current binary values and previous binary values. Alternatively, or in addition, each of the encoded signals comprises at least one period of time for providing a maximum voltage. Alternatively, or in addition, the logic can transmit the encoded signal directly to the display panel without amplification. Alternatively, or in addition, each of the encoded signals can include a different density of encoded pulses based on each different gray value. Alternatively, or in addition, the logic can repeatedly send the encoded signal to the display at a predetermined frame rate. Alternatively, or in addition, the display panel can be a micro-LED display panel. Alternatively, or in addition, each gray value can represent a number of pulses to be included in each encoded signal.

EXAMPLE 2

In some embodiments, a method for controlling a display with a digital signal can include detecting a binary value from a timing controller, the binary value corresponding to a portion of an image to be displayed and determining a previous binary value from the timing controller. The method can also include calculating a difference between the binary value from the timing controller and the previous binary value from the timing controller and generating an encoded signal based on the difference. Furthermore, the method can include transmitting the encoded signal to a display panel.

Alternatively, or in addition, the method can include generating a set of encoded signals, wherein each of the encoded signals corresponds to a separate gray value based on a separate difference value between current binary values and previous binary values. Alternatively, or in addition, each of the encoded signals comprises at least one period of time for providing a maximum voltage. Alternatively, or in addition, the method can include transmitting the encoded signal directly to the display panel without amplification. Alternatively, or in addition, each of the encoded signals can include a different density of encoded pulses based on each different gray value. Alternatively, or in addition, the method can include repeatedly sending the encoded signal to the display at a predetermined frame rate. Alternatively, or in addition, the display panel can be a micro-LED display panel. Alternatively, or in addition, each gray value can represent a number of pulses to be included in each encoded signal.

EXAMPLE 3

In some examples, a system for controlling display panels with digital signals can include a display panel to display an image and logic to detect a binary value from a timing controller, the binary value corresponding to a portion of an image to be displayed. The logic can also determine a previous binary value from the timing controller and calculate a difference between the binary value from the timing controller and the previous binary value from the timing controller. Additionally, the logic can generate an encoded signal based on the difference and transmit the encoded signal to a display panel, the encoded signal to cause a timing sequence of a maximum voltage to be applied to the display panel.

Alternatively, or in addition, the logic can generate a set of encoded signals, wherein each of the encoded signals corresponds to a separate gray value based on a separate difference value between current binary values and previous binary values. Alternatively, or in addition, each of the encoded signals comprises at least one period of time for providing a maximum voltage. Alternatively, or in addition, the logic can transmit the encoded signal directly to the display panel without amplification. Alternatively, or in addition, each of the encoded signals can include a different density of encoded pulses based on each different gray value. Alternatively, or in addition, the logic can repeatedly send the encoded signal to the display at a predetermined frame rate. Alternatively, or in addition, the display panel can be a micro-LED display panel. Alternatively, or in addition, each gray value can represent a number of pulses to be included in each encoded signal. Alternatively, or in addition, the maximum voltage can correspond to a maximum voltage that a micro-LED of the display panel is enabled to receive without damage to the micro-LED.

EXAMPLE 4

In some embodiments, a system for controlling a display panel with a digital signal can include a means for detecting a binary value from a timing controller, the binary value corresponding to a portion of an image to be displayed. The system can also include means for determining a previous binary value from the timing controller and calculating a difference between the binary value from the timing controller and the previous binary value from the timing controller. Furthermore, the system can include means for generating an encoded signal based on the difference and transmitting the encoded signal to the display panel.

Although an example embodiment of the disclosed subject matter is described with reference to block and flow diagrams in FIGS. 1-3, persons of ordinary skill in the art will readily appreciate that many other methods of implementing the disclosed subject matter may alternatively be used. For example, the order of execution of the blocks in flow diagrams may be changed, and/or some of the blocks in block/flow diagrams described may be changed, eliminated, or combined.

In the preceding description, various aspects of the disclosed subject matter have been described. For purposes of explanation, specific numbers, systems and configurations were set forth in order to provide a thorough understanding of the subject matter. However, it is apparent to one skilled in the art having the benefit of this disclosure that the subject matter may be practiced without the specific details. In other instances, well-known features, components, or modules were omitted, simplified, combined, or split in order not to obscure the disclosed subject matter.

Various embodiments of the disclosed subject matter may be implemented in hardware, firmware, software, or combination thereof, and may be described by reference to or in conjunction with program code, such as instructions, functions, procedures, data structures, logic, application programs, design representations or formats for simulation, emulation, and fabrication of a design, which when accessed by a machine results in the machine performing tasks, defining abstract data types or low-level hardware contexts, or producing a result.

Program code may represent hardware using a hardware description language or another functional description language which essentially provides a model of how designed hardware is expected to perform. Program code may be assembly or machine language or hardware-definition languages, or data that may be compiled and/or interpreted. Furthermore, it is common in the art to speak of software, in one form or another as taking an action or causing a result. Such expressions are merely a shorthand way of stating execution of program code by a processing system which causes a processor to perform an action or produce a result.

Program code may be stored in, for example, volatile and/or non-volatile memory, such as storage devices and/or an associated machine readable or machine accessible medium including solid-state memory, hard-drives, floppy-disks, optical storage, tapes, flash memory, memory sticks, digital video disks, digital versatile discs (DVDs), etc., as well as more exotic mediums such as machine-accessible biological state preserving storage. A machine readable medium may include any tangible mechanism for storing, transmitting, or receiving information in a form readable by a machine, such as antennas, optical fibers, communication interfaces, etc. Program code may be transmitted in the form of packets, serial data, parallel data, etc., and may be used in a compressed or encrypted format.

Program code may be implemented in programs executing on programmable machines such as mobile or stationary computers, personal digital assistants, set top boxes, cellular telephones and pagers, and other electronic devices, each including a processor, volatile and/or non-volatile memory readable by the processor, at least one input device and/or one or more output devices. Program code may be applied to the data entered using the input device to perform the described embodiments and to generate output information. The output information may be applied to one or more output devices. One of ordinary skill in the art may appreciate that embodiments of the disclosed subject matter can be practiced with various computer system configurations, including multiprocessor or multiple-core processor systems, minicomputers, mainframe computers, as well as pervasive or miniature computers or processors that may be embedded into virtually any device. Embodiments of the disclosed subject matter can also be practiced in distributed computing environments where tasks may be performed by remote processing devices that are linked through a communications network.

Although operations may be described as a sequential process, some of the operations may in fact be performed in parallel, concurrently, and/or in a distributed environment, and with program code stored locally and/or remotely for access by single or multi-processor machines. In addition, in some embodiments the order of operations may be rearranged without departing from the spirit of the disclosed subject matter. Program code may be used by or in conjunction with embedded controllers.

While the disclosed subject matter has been described with reference to illustrative embodiments, this description is not intended to be construed in a limiting sense. Various modifications of the illustrative embodiments, as well as other embodiments of the subject matter, which are apparent to persons skilled in the art to which the disclosed subject matter pertains are deemed to lie within the scope of the disclosed subject matter.

What is claimed is:

1. A system for controlling a display panel with a digital signal comprising circuitry configured to:

detect a binary value from a timing controller, the binary value corresponding to a portion of an image to be displayed;

determine a previous binary value from the timing controller;

calculate a difference between the binary value from the timing controller and the previous binary value from the timing controller;

generate an encoded signal based on the difference; and transmit the encoded signal to the display panel, wherein the encoded signal corresponds to a gray value and a density of encoded pulses in the encoded signal is based on the gray value.

2. The system of claim 1, wherein the circuitry is further configured to generate a plurality of encoded signals, wherein each of the plurality of encoded signals corresponds to a separate gray value of a plurality of gray values based on a separate difference value between current binary values and previous binary values.

3. The system of claim 1, wherein the encoded signal specifies at least one time period to provide a maximum voltage.

4. The system of claim 1, wherein the circuitry is further configured to transmit the encoded signal directly to the display panel without amplification.

5. The system of claim 2, wherein each of the plurality of encoded signals comprises a different density of encoded pulses corresponding to a gray value.

6. The system of claim 1, wherein the circuitry is further configured to repeatedly send the encoded signal to the display panel at a predetermined frame rate.

7. The system of claim 1, wherein the display panel is a micro-LED display panel.

8. The system of claim 1, wherein the gray value represents a number of pulses to be included in the encoded signal.

9. A method for controlling a display panel with a digital signal comprising:

detecting a binary value from a timing controller, the binary value corresponding to a portion of an image to be displayed;

determining a previous binary value from the timing controller;

calculating a difference between the binary value from the timing controller and the previous binary value from the timing controller;

generating an encoded signal based on the difference; and transmitting the encoded signal to the display panel, wherein the encoded signal corresponds to a gray value and a density of encoded pulses in the encoded signal is based on the gray value.

10. The method of claim 9, further comprising:

generating a plurality of encoded signals, wherein each of the plurality of encoded signals corresponds to a separate gray value of a plurality of gray values based on a separate difference value between current binary values and previous binary values.

11. The method of claim 9, wherein the encoded signal comprises at least one time period for providing a maximum voltage.

12. The method of claim 9, further comprising transmitting the encoded signal directly to the display panel without amplification.

13. The method of claim 10, wherein each of the plurality of encoded signals comprises a different density of encoded pulses corresponding to a gray value.

14. The method of claim 9, further comprising repeatedly sending the encoded signal to the display panel at a predetermined frame rate.

15. The method of claim 9, wherein the display panel is a micro-LED display panel.

16. A system for controlling display panels with digital signals comprising:

a display panel to display an image; and circuitry configured to:

detect a binary value from a timing controller, the binary value corresponding to a portion of the image to be displayed;

determine a previous binary value from the timing controller;

calculate a difference between the binary value from the timing controller and the previous binary value from the timing controller;

generate an encoded signal based on the difference; and transmit the encoded signal to the display panel to apply a timing sequence of a maximum voltage to the display panel, wherein the encoded signal corresponds to a gray value and a density of encoded pulses in the encoded signal is based on the gray value.

17. The system of claim 16, wherein the maximum voltage corresponds to a maximum voltage that a micro-LED of the display panel is enabled to receive without damage to the micro-LED.

18. The system of claim 16, wherein the circuitry is further configured to generate a plurality of encoded signals, wherein each of the plurality of encoded signals corresponds to a separate gray value of a plurality of gray values based on a separate difference value between current binary values and previous binary values.

19. The system of claim 16, wherein the circuitry is further configured to transmit the encoded signal directly to the display panel without amplification.

20. The system of claim 16, wherein the circuitry is further configured to repeatedly send the encoded signal to the display panel at a predetermined frame rate.

* * * * *